US005201475A

United States Patent [19]

Nakagomi

[11] Patent Number: 5,201,475

[45] Date of Patent: Apr. 13, 1993

[54] DOUBLE SHAFT BREAKER

[76] Inventor: Shoji Nakagomi, 518-1, Shirakuwa, Urawa-shi, Saitama, Japan

[21] Appl. No.: 896,957

[22] Filed: Jun. 11, 1992

[30] Foreign Application Priority Data

Jul. 17, 1991 [JP] Japan ..... 3-202564

[51] Int. Cl.[5] ..... B02C 18/44

[52] U.S. Cl. ..... 241/236; 241/243

[58] Field of Search ..... 241/236, 243

[56] References Cited

U.S. PATENT DOCUMENTS

| | | | |
|---|---|---|---|
| 2,297,604 | 9/1942 | Bateman et al. | 241/243 X |
| 2,398,932 | 4/1946 | Grant | 241/243 X |
| 2,429,157 | 10/1947 | Fowler | 241/243 X |
| 4,385,732 | 5/1983 | Williams | 241/236 |
| 4,538,766 | 9/1985 | Vandenbussche | 241/243 X |
| 4,753,395 | 6/1988 | Paugh | 241/243 X |
| 4,925,116 | 5/1990 | Lundell | 241/236 |
| 4,995,770 | 2/1991 | Crane | 241/236 X |
| 5,110,060 | 5/1992 | Lundquist | 241/236 |

FOREIGN PATENT DOCUMENTS

| | | | |
|---|---|---|---|
| 18722 | 3/1913 | Denmark | 241/236 |
| 2831953 | 12/1979 | Fed. Rep. of Germany | 241/236 |
| 45173 | 7/1935 | France | 241/236 |
| 3232860 | 9/1988 | Japan | 241/236 |
| 51297 | 7/1919 | Sweden | 241/236 |

*Primary Examiner*—Mark Rosenbaum

*Assistant Examiner*—Frances Chin

*Attorney, Agent, or Firm*—Jordan and Hamburg

[57] ABSTRACT

A double shaft breaker for use in breaking plastic wastes and wastes of metal cans so that the materials can be used again. The double shaft breaker comprises two driving shafts supported rotatably in parallel with each other in apparatus frames, a plurality of shredding large cutters fixed to each of said driving shafts with a prescribed interval between the shredding large cutters, said shredding large cutters on the right and left being opposed to each other or being apart from each other, the rotational angle of said shredding large cutters on the right being the same as that of said shredding large cutters on the left or said shredding large cutters on the right being meshed with said shredding large cutters on the left, or the sides of the shredding large cutters on the right being slidably engaged with the sides of said shredding large cutters on the left, a pair of breaking small cutters fixed between the shredding large cutters with a prescribed interval between the shredding small cutters, stationary blades located between the pair of the breaking small cutters, a pair of guide plates located between said shredding large cutters and the apparatus frame, drop preventive covers located along the rotational radius of said pair of shredding large cutters, and a driving apparatus for rotating the driving shafts in such directions that objects to be broken may be broken by the edges of said breaking small cutters and the edges of the stationary blades.

5 Claims, 2 Drawing Sheets

DOUBLE SHAFT BREAKER

FIELD OF THE INVENTION

The present invention relates to a breaker, and more particularly to a double shaft breaker for use in breaking plastic wastes and metal can wastes so that the materials can be used again.

DESCRIPTION OF PRIOR ART

Generally, in order to reuse plastic wastes, it is well known to break the plastic wastes into pellets and to mix the pellets with virgin pellets. An example of such a conventional breaker for breaking plastic wastes into pellets is disclosed in Japanese Utility Model Gazette 61-3461 (1986) to the present inventor issued on February 3, 1986. The constitution of the breaker for plastic wastes disclosed therein is described with reference to FIG. 3 . A driving shaft 2 is supported horizontally in an apparatus frame 1 and rough breaking blades 3 and fine breaking blades are secured to the driving shaft 2 with the driving shaft through the blades 3 and 4. One stationary comb blade 5 is opposed to the rough breaking blades 3 and the fine breaking blades at a position where resin molded articles will be broken and a receiving plate 6 for scraping resin molded articles adhered to the blades is opposed to the rough breaking blades 3 and the fine breaking blades 4 in the symmetrical position in relation to the stationary comb blade 5. A receiver 7 for preventing broken pieces resulted from the rough breaking by the rough breaking blades 3 from dropping outside the apparatus frame is located in a position surrounding approximately lower half of the rough breaking blades 3. In this prior art single-shaft-driven breaker, however, since the rough breaking blades 3 and the fine breaking blades 4 attached to the driving shaft 2 are opposed to the one stationary comb blade 5, there is only a difference in the relative speed upon the passage of the rough breaking blades 3 and the fine breaking blades 4 through the stationary comb blade 5. Consequently, there is a defect that when objects are broken, the objects tumble about in the apparatus frame thereby resulting in failure of the breaking or that if broken pieces adhere to the stationary comb blade 5 and the adhered broken pieces take shapes corresponding to the shapes of the rough breaking blades 3 and the fine breaking blade 4, the breaking power is no longer exhibited.

SUMMARY OF THE INVENTION

The object of the present invention is to provide a double shaft breaker for use in breaking plastic wastes and wastes of metal cans so that the materials can be used again.

A double shaft breaker according to the present invention comprises two driving shafts supported rotatably in parallel with each other in apparatus frames, a plurality of shredding large cutters fixed to each of said driving shafts with a prescribed interval between the shredding large cutters, a pair of breaking small cutters fixed between the shredding large cutters with a prescribed interval between the shredding small cutters, stationary blades located between the pair of the breaking small cutters, a pair of guide plates located between said shredding large cutters and the apparatus frame, drop preventive covers located along the rotational radius of said pair of shredding large cutters, and a driving apparatus for rotating the driving shafts in such directions that objects to be broken may be broken by the edges of said breaking small cutters and the edges of the stationary blades. In the thus constituted double shaft breaker, the pair of shredding large cutters and the breaking small cutters are rotated in opposite directions in relation to each other with the rotational frequencies of the shredding large cutters and the breaking small cutters being the same or different. Out of objects to be broken which are charged into the apparatus frames, larger ones are dragged in and broken by the shredding large cutters. The thus broken objects are further broken by the pair of breaking small cutters in cooperation with the central stationary blades. Accordingly the present invention has an excellent breaking effect without defects associated with the prior art single shaft shredding large cutters and breaking small cutters, for example, defects that objects to be broken tumble about in the apparatus frame and are not broken when they are to be broken and that objects to be broken adhere to the stationary comb blade and take shapes corresponding to the shapes of the rough breaking blades and the fine breaking blade and therefore the breaking power is no longer exhibited.

DESCRIPTION OF PREFERRED EMBODIMENT

Figure 1:
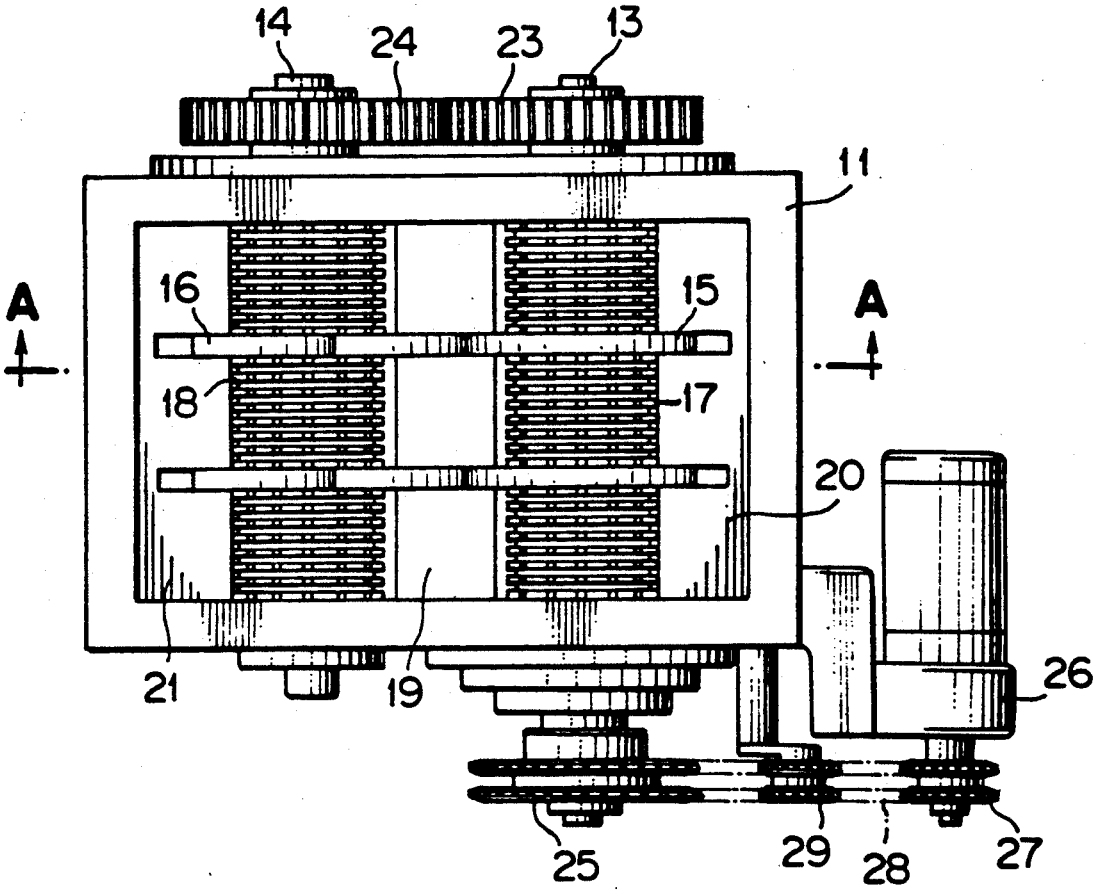
FIG. 1 is a plane view of a double shaft breaker illustrating an embodiment according to the present invention.
Figure 2:
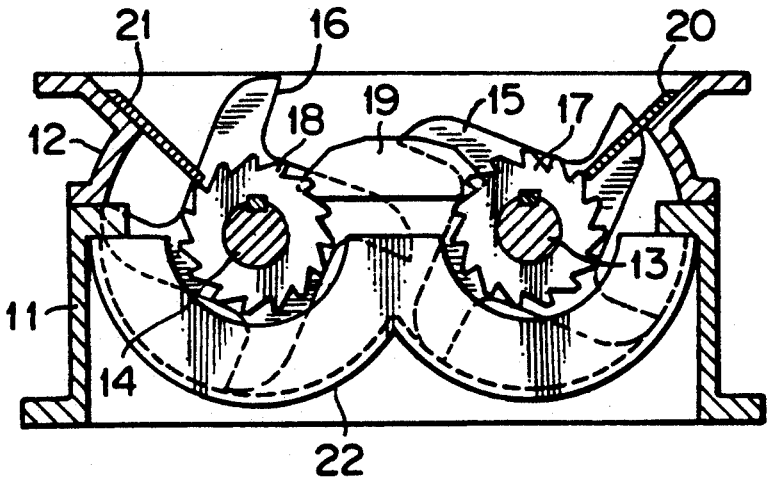
FIG. 2 is a cross-sectional view taken along line A-A of FIG. 1.
Figure 3:
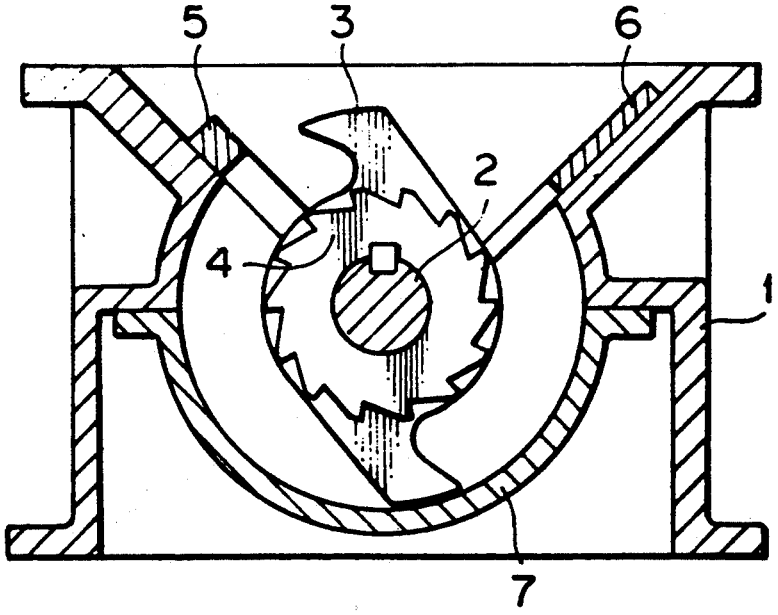
FIG. 3 PRIOR ART
FIG. 3 is a cross-sectional view illustrating a prior art breaker.

An embodiment of the present invention is described with reference to FIGS. 1 and 2. Two driving shafts 13 and 14 which are parallel to each other are rotatably supported in apparatus frames 11 and 12. A plurality of shredding large cutters 15 and 16 are fixed to the driving shafts 13 and 14. In this case, the shredding large cutters 15 and 16 are fixed to the driving shafts 13 and 14 with the shredding large cutters 15 opposed to the shredding large cutters 16 and with a prescribed interval between the shredding large cutters 15 (16).

Alternatively, the shredding large cutters 15 and 16 may be fixed to the driving shafts 13 and 14 with the side of shredding large cutters 15 slidably engageable with the side of the shredding large cutters 16 or with the shredding large cutters 15 apart from the shredding large cutters 16. Herein, the rotational angle of the shredding large cutters 15 and the rotational angle of the shredding large cutters 16 are the same or are made such that the shredding large cutters 15 may mesh with the shredding large cutters 16. Breaking small cutters 17 (18) are fixed between the shredding large cutters 15 (16) with a prescribed interval between the breaking small cutters 17 (18). Stationary blades 19 are fixed to the apparatus frame 11 between the pair of the breaking small cutters 17 and 18 and a pair of guide plates 20 and 21 are placed between the shredding large cutters 15 and 16 and the apparatus frame 12. The apparatus frame 12 is provided with drop preventive covers 22 along the rotational radius of the shredding large cutters 15 and 16. The driving shafts 13 and 14 are rotated by a driving apparatus so that objects to be broken may be broken by the edges of said breaking small cutters 17 and 18 and the edges of the stationary blades. In this driving apparatus, gears 23 and 24 are fixed to one end of the driving shafts 13 and 14 and are meshed with each other. Herein, the number of teeth of the gear 23 and the number of the teeth of the gear 23 may be selected to be the same or different. The other end of the driving shaft 13 is provided with a chain wheel 25 which is in turn associated with a chain wheel 27 of a reduction gear-equipped motor 26 fixed to the apparatus frame 11 through a chain 28. The chain 28 is made taut by a tension 29. When the driving shaft 13 and the chain gear 25 in association with the chain gear 27 though the chain 28 are rotated by driving the reduction gear-equipped motor 26, the gears 23 and 24 rotate Q the driving shaft 14 in the direction opposite to that of the rotation of the driving shaft 13. Therefore, the pair of the shredding large cutters 15 and 16 are rotated with their rotational frequencies being the same or different and with the rotational angles of them being the same or with them meshed with each other. Larger ones out of objects to be broken such as plastic wastes and metal cans charged into the apparatus frame 12 are dragged and broken roughly by the shredding large cutters 15 and 16. The broken objects are moved back to the apparatus frame 12 by the dropping. preventive covers 22 arranged below the shred guide plates 20 and 21 and are broken by the breaking small cutters 17 and 18 arranged in line with the shredding large cutters 15 and 16. Since the drop preventive covers 22 are located below the guide plates 20 and 21, only the objects broken by the breaking small cutters 17 and 18 drop out of the apparatus frames 11 and 12.

What is claimed is:

1. A double shaft breaker according to the present invention, comprising two driving shafts supported rotatably in parallel with each other in apparatus frames, a plurality of shredding large cutters fixed to each of said driving shafts with a prescribed interval between the shredding large cutters, a pair of breaking small cutters fixed between the shredding large cutters with a prescribed interval between the shredding small cutters, stationary blades located between the pair of the breaking small cutters, a pair of guide plates located between said shredding large cutters and the apparatus frame, drop preventive covers located along the rotational radius of said pair of shredding large cutters, and a driving apparatus for rotating the driving shafts in such directions that objects to be broken may be broken by the edges of said breaking small cutters and the edges of the stationary blades.

2. A double shaft breaker according to claim 1, the plurality of shredding large cutters are fixed to the driving shafts with the shredding large cutters on the right and left being located to oppose to each other.

3. A double shaft breaker according to claim 1, wherein the plurality of the shredding large cutters are fixed to the driving shafts with the shredding large cutters on the right being apart from the shredding large cutters on the left.

4. A double shaft breaker according to claim 1, wherein the rotational angle of the plurality of the shredding large cutters on the right is the same as that of the plurality of the shredding large cutters on the left.

5. A double shaft breaker according to claim 1, wherein the rotational angles of the plurality of the shredding large cutters are such that the shredding large cutters on the right are meshed with the large shredding large cutters on the left.

* * * * *